US005405019A

United States Patent [19]

Cross

[11] Patent Number: 5,405,019

[45] Date of Patent: Apr. 11, 1995

[54] DISPLAY MOUNT AND BOOK SUPPORT

[76] Inventor: Carroll N. Cross, 3202 Holiday Ave., Apopka, Fla. 32703

[21] Appl. No.: 149,111

[22] Filed: Nov. 9, 1993

[51] Int. Cl.[6] ..... A47B 65/00

[52] U.S. Cl. ..... 211/42; 211/43; 211/70.1; 211/85; 248/174

[58] Field of Search ..... 211/42, 43, 70.1, 85, 211/169.1, 184; 248/174, 178, 441.1, 460, 461; D19/34.1

[56] References Cited

U.S. PATENT DOCUMENTS

| | | | |
|---|---|---|---|
| 1,543,102 | 6/1925 | Fleischer | 248/174 |
| 2,225,830 | 12/1940 | Hams | 281/33 |
| 2,355,706 | 8/1944 | Cross | 93/1 |
| 3,002,720 | 10/1961 | Cross | 248/35 |
| 3,058,401 | 10/1962 | Cross | 93/1 |
| 3,068,139 | 12/1962 | Cross | 156/213 |
| 3,079,715 | 3/1963 | Cross | 40/159 |
| 3,188,113 | 6/1965 | Cross | 281/15 |
| 3,216,582 | 11/1965 | Cross | 211/50 |
| 3,561,595 | 2/1971 | Weggeland | 206/387 |
| 4,199,883 | 4/1980 | Cross | 40/152.1 |
| 4,263,733 | 4/1981 | Cross | 40/121 |
| 4,285,683 | 8/1981 | Cross | 493/325 |
| 4,288,935 | 9/1981 | Cross | 40/120 |
| 4,299,643 | 11/1981 | Cross | 156/223 |
| 4,326,906 | 4/1982 | Cross | 156/201 |
| 4,351,123 | 9/1982 | Cross | 40/120 |
| 4,696,118 | 9/1987 | Cross | 40/120 |

FOREIGN PATENT DOCUMENTS

| | | | |
|---|---|---|---|
| 657236 | of 1963 | Canada | 248/174 |
| 646568 | of 1928 | France | 211/43 |

*Primary Examiner*—Leslie A. Braun
*Assistant Examiner*—Catherine S. Collins
*Attorney, Agent, or Firm*—William M. Hobby, III

[57] ABSTRACT

A display mount and book support apparatus includes a base panel adapted to sit on a surface along with a pair of angled panels each attached to one edge of the base panel with a ductile hinge and extending at an angle over the base panel. A pair of generally upright panels are each attached to one edge of one angled panel and extend in a generally vertically direction. The upright panels are spaced from each other in a generally parallel spaced relationship whereby books or other materials can be wedged between the upright panels and rest on one side of the base panel. The ductile hinges are of an increased rigidity over those normally used in the industry and have been alloyed with magnesium, copper, iron and manganese to thereby increase the resistance to bending.

12 Claims, 2 Drawing Sheets

DISPLAY MOUNT AND BOOK SUPPORT

BACKGROUND OF THE INVENTION

The present invention relates to a display mount and especially to display mounts adapted to support books and loose materials therein for rapid access to the supported items.

In the past, there have been a variety of U-shaped holders for sheet materials, such as envelopes, note paper, paper napkins, memo pads, calendars, and the like, but such holders generally have been constructed of stiff, cast metal or molded plastic shaped into their ultimate form at the point of fabrication. These type of holders present obvious storage and shipping problems which have been avoided by foldable shaped structures. However, foldable paper stock holders have not generally been successful because the cardboard and similar paper stock materials have a high degree of resiliency which tends to bend under stress and inasmuch as the hinges where the panels are folded do not hold heavy or larger items, such as small books and the like. The larger items, such as books, tend to both tilt over in U-shaped holders and also bend the hinges out of shape. Applicant's prior patent for a Foldable Sheet Holder, U.S. Pat. No. 3,216,582, of Nov. 9, 1965 shows a U-shaped holder for holding sheets of material which has a pair of upright panels which rotate on a base element such that the upright panels can be folded on a hinged area and collapsed for packing and shipping. However even so, this prior patent used a pair of panels for the upright portions to increase the strength of the U-shaped holder. Another of Applicant's patents which shows a U-shaped holder may be seen in U.S. Pat. No. 4,351,123 for a U-shaped holder which includes ductile hinges for positioning the U-shaped holder, along with a transparent banding to support a calendar or display on one side thereof. Other calendar mounts and the like which can hold a few envelopes or sheets or material can be seen in a wide variety of patents, such as Applicant's prior Pat. No. 4,696,118 for a Desk Calendar. Applicant also has a wide variety of patents extending over 50 years which relate to display mounts, desk calendars, and the like.

Typical display mounts for calendar pads and the like may be seen in my prior U.S. Pat. No. 2,355,706 for a display mount having a well in the face thereof for displaying materials such as calendar pads, and in U.S. Pat. Nos. 3,058,410 and 3,079,715 for an improved display mount structure and improved method for forming the display windows and display wells in display mount structures. In addition, my prior patents on displays and photomounts may be seen in U.S. Pat. Nos. 3,216,582; 3,068,139; and 3,002,720, which includes my patent on an aluminum hinge which allows a supporting prop or other display mount supports to be mounted with a flexible hinged panel which stays in place without the use of interconnecting tongues, or the like. Other display mount patents of mine include a Display Mount Apparatus and Method, U.S. Pat. No. 4,523,399; a Display Mount, U.S. Pat. No. 4,199,883; a Display Mount and Method, U.S. Pat. No. 4,351,123; a Display Mount with Protected Thermometer, U.S. Pat. No. 4,263,733; a Display Mount and Method, U.S. Pat. No. 4,326,906; a Method of Making a Display Mount, U.S. Pat. No. 4,285,683; and a Method of Making a Hinged Display Mount, U.S. Pat. No. 4,299,643. In my prior Patent for Display Book Apparatus, U.S. Pat. No. 4,288,935, I combined a display and book combination which allowed a calendar to swing forward to give access for a phone or reference book. My U.S. Pat. No. 3,188,113 is for a Paper Holder with V-shaped pen receptacle, and like the present invention has a display mount with pencil or pen holder formed therein but supported in a manner different from the present invention and requires five panels and supports the pens with a V-shaped pair of panels below the pen holding apertures.

The present invention advantageously provides a display mount which will support larger items, such as books and materials, and which at the same time can be folded for packing and shipping while maintaining the lightweight of a paperboard desk top display mount using single panels. This display mount allows for calendar and advertising material to be displayed on a person's desk while at the same time supporting a commonly used book or large numbers of papers and envelopes and can be converted to a book end support and adds the strength to support the heavier upright material against the hinged areas as well as parallel upper surfaces or two panels and avoids falling over of the display. The display and support utilizes a combination of a shape to add greater strength to the structure against falling over as well as significantly improves the strength of the hinges against bending under the mass of the supported materials.

SUMMARY OF THE INVENTION

A display mount and book support apparatus includes a base panel adapted to sit on a surface along with a pair of angled panels each attached to opposite parallel edges of the base panel with a ductile hinge and extending at an angle over the base panel. A pair of generally upright panels are each attached by a ductile hinge to one edge of one angled panel and extending in a generally vertically direction. The upright panels are spaced from each other in a generally parallel spaced relationship whereby books or other materials can be wedged between the upright panels and rest the upper side of the base panel. The ductile hinges may have an increased thickness over those normally used in the industry and have been alloyed with magnesium, copper, iron and manganese to thereby increase the resistance to bending and avoid fracture even with frequent bending.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
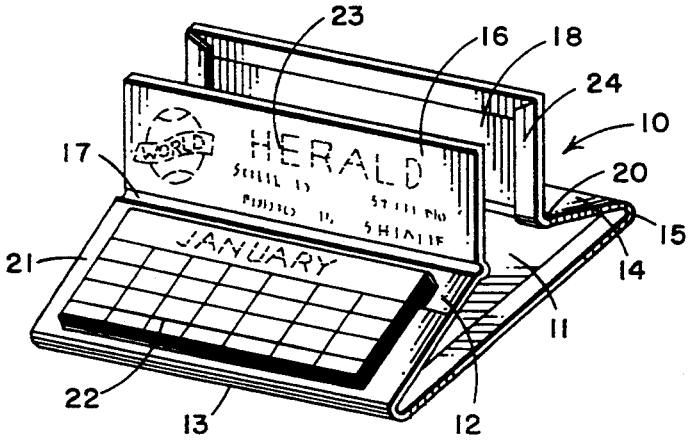
FIG. 1 is a perspective view of the display mount in accordance with the present invention.

Referring to FIGS. 1–8 of the drawings and especially to FIG. 1, a display mount and book or item support 10 has a base panel 11 for sitting on a surface with an angled panel 12 hinged with a heavy ductile hinge 13 at an oppositely angled panel 14 hinged with a ductile hinge 15. The panel 12 has a generally vertical or upright panel 16 hinged at 17 with a heavy ductile hinge while the panel 14 has a generally vertical or upright panel 18 hinged at 20 to the panel 14. A transparent band 21 is banded around a portion of the panel 12 and can overlap the hinge 13 and supports a calendar pad 22 with part of the pages placed behind the banding 21. The upright panel 16 has indicia, logos, and the like 23 printed thereon, such as advertising material, which may also be placed upon the outside of the panel 18. The panels are shown case bound with a case binding 24 over their outside and may be laminated with a paper on the inside thereof.

Figure 2:
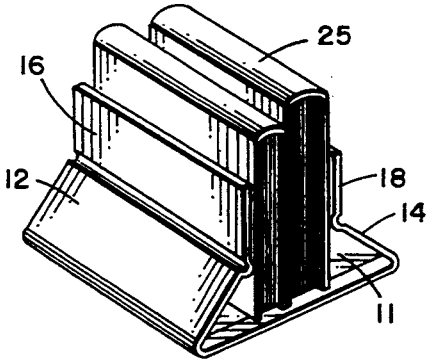
FIG. 2 is a perspective view of the display mount of FIG. 1 supporting books.
Figure 3:
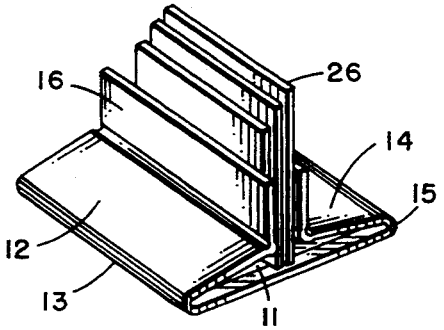
FIG. 3 is a perspective view of the display mount of FIG. 1 supporting papers.
Figure 4:
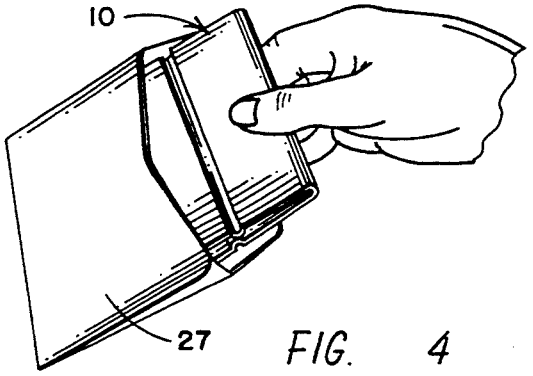
FIG. 4 is a perspective view of the display mount of FIGS. 1–3 folded and being inserted into a packing envelope.
Figure 5:
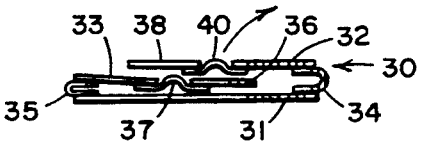
FIGS. 5–8 are side elevations of a partially finished display mount illustrating the steps of setting the display mount up from the folded position.

In FIG. 2, a pair of books 25 are shown supported in the display mount 10 between the panels 16 and 18 and supported therein resting on the base panel 11. Depending upon the thickness of the books 25, the angled panels 12 and 14 can be pushed down to wedge the panels 16 and 18 against the books. For thinner materials, such as shown in FIG. 5, with a pad and plurality of papers 26 supported therein, the angle between the angled panels 12 and 14 and the base panel 11 is shown to be of a much smaller angle with the angle members 12 and 14 bent further on the ductile hinges 13 and 15. Because ductile hinges are used for the hinge supports, the entire display mount 10 can be folded into a smaller flat shape, as shown in FIG. 4, and inserted into an envelope 27 for shipment or mailing. The shipping weight is kept down by the use of lightweight single paperboard type panels for the panels 11, 12, 14, 16, and 18.

Figure 6:
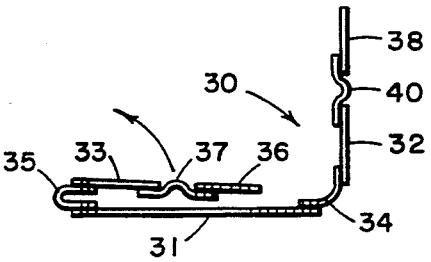
Figure 7:
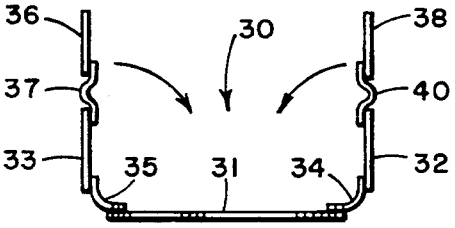
Figure 8:
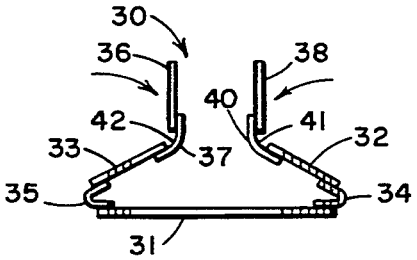
Figure 9:
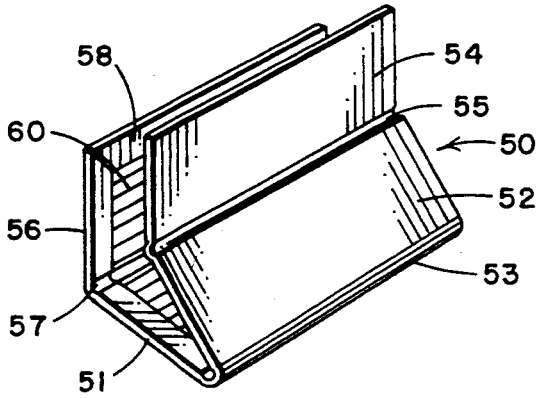
FIG. 9 is a perspective view of an alternate embodiment of the display mount of FIGS. 1–8.

In FIGS. 5–8 the unfolding and set up of the display mount is illustrated with a partially finished display mount and book support 30 which has not been case bound, laminated or finished with the banding calendar or printing and has an unfinished base panel 31 having an angled panel 32 and an angled panel 33 hinged thereto with a heavy ductile aluminum alloy hinge 34 and 35. The panel 33 in turn has the upright panel 36 hinged with a heavy aluminum alloy hinge 37 and the generally vertical panel 38 is hinged with the heavy aluminum alloy 40. In FIG. 5, the panel is folded as in FIG. 4 and is opened as shown in FIGS. 6 and 7 and then folded to position the panels 36 and 38 in a generally vertical or upright position. The nature of the folding generally requires a larger spacing at the hinge portions 41 and 42. For the hinge to be able to make the complete folds, the aluminum alloy used for all ductile hinges 34, 35, 37 and 40 are all made of a heavy aluminum alloy, such as 0.008 inches thick or greater than 0.007 inches thick, which is considerably heavier and more difficult to work in automated machinery than the conventional aluminum hinge that I have used in the past or that others have used, which is 0.006 inches thick. In addition, prior aluminum hinges have been made substantially of aluminum without the addition of other metals while the present ductile hinges are given greater strength to support the heavier weights against the bending of the aluminum hinge by the addition of small amounts of magnesium, copper, iron, and manganese. The alloy currently being used includes about 95% to 96% aluminum with approximately 1½% magnesium and small amounts of manganese, copper and iron which produces an aluminum alloy which has been found to substantially increase the supporting strength and which will bend approximately ten times more than prior aluminum hinges.

Figure 10:
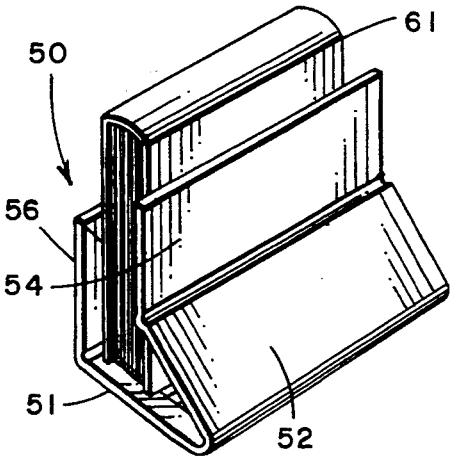
FIG. 10 is a perspective view of the display mount of FIG. 9 supporting a book therein.
Figure 12:
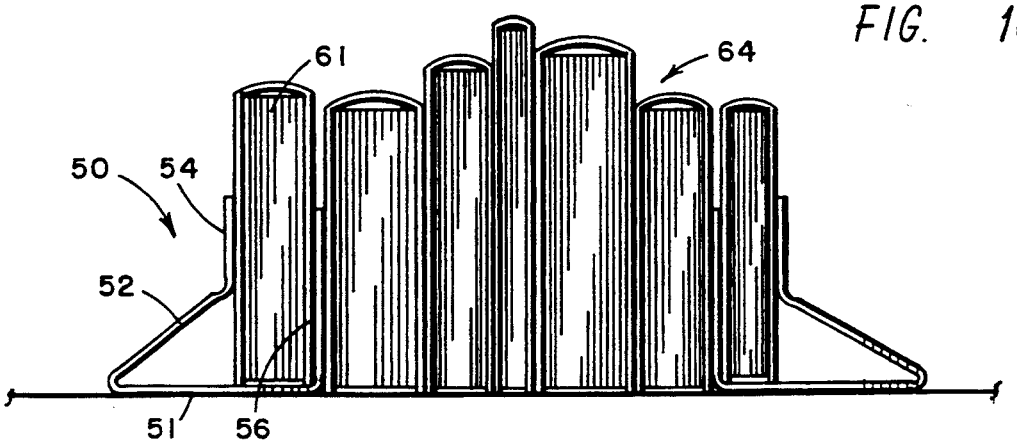
FIG. 12 is a side elevation of a pair of display mounts of FIG. 9 supporting a grouping of books.
Figure 13:
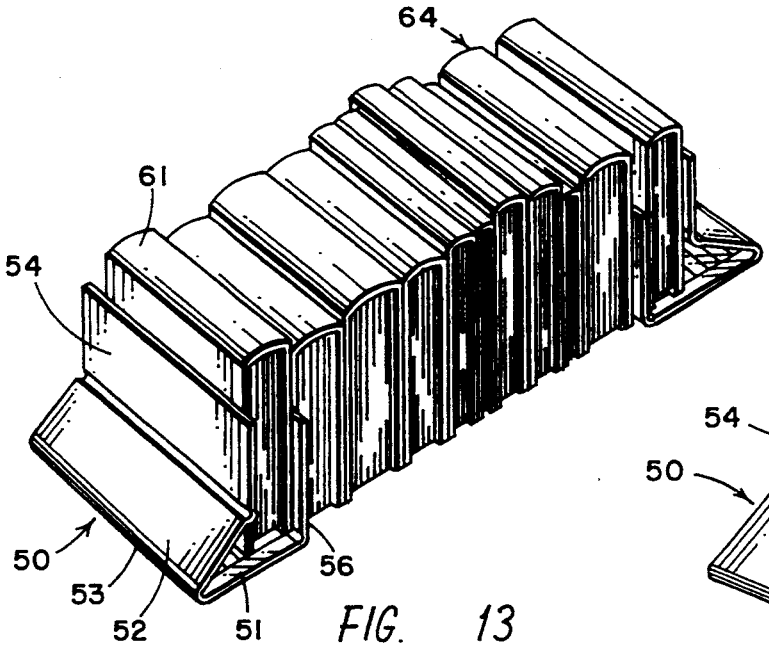
FIG. 13 is a perspective view of the supported books of FIG. 12.
Figure 11:
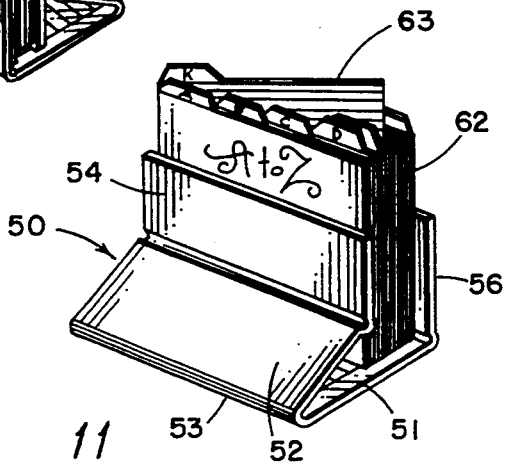
FIG. 11 is a perspective view of the display mount of FIG. 9 supporting a recipe box therein.

Turning now to FIGS. 9–13, an alternative embodiment of a display mount and book and paper support 50 is illustrated having a base panel 51 with an angled panel 52 having a ductile hinge 53 and having a generally vertically or upright extending panel 54 with a ductile hinge 55. A rear supporting panel 56 generally extends in an upright or generally vertically direction and has a ductile hinge 57 attaching it to the base panel 51. All of the panels are case bound with a case binding 58 and have a paper or other laminate covering 60 on the inside of the panels. These panels would typically have printed indicia on the front of the panel 54 as well as the front of the rear panel 56 and would have a calendar attached to the angled panel 52 with staples or a banding, as shown in connection with FIG. 1. This embodiment can support a book 61, as shown in FIG. 10, or a container full of recipes 62, as shown in FIG. 11, having the alphabetized recipe cards 63 therein. A pair of the supports 50 holding one book 61 each can be used as book ends and placed between a plurality of additional books 64, as shown in FIGS. 12 and 13. This embodiment, as will be understood, is similar to the embodiment of FIGS. 1–8 except for the one panel replacing two panels and includes the heavier aluminum alloy hinges of a special aluminum alloy.

It should be clear at this point that a display mount and book, paper or miscellaneous item support has been provided which has greater strength against the support turning over with the heavier items therein by the width of the base panel and by the wedging of the angled panels to support the vertical panels against the items therein. The advantages from a heavier aluminum specially alloyed with other metals gives greater strength to holding the heavier items in place without bending the hinges but still allows the hinges to be reshaped for supporting different items. Thus, larger items are supported from both tilting and from bending at the hinges even though single paper board panels are used for the supporting panels. The heavier aluminum hinges are still able to be worked by automated machinery. The present invention is not to be construed as limited to the forms shown which are to be considered illustrative rather than restrictive.

I claim:

1. A display mount and book support comprising:

a base panel having a plurality of edges and adapted to be set on a surface;

a first panel attached by a ductile hinge to said base panel along one edge of said base panel and angled over said base panel;

a second panel attached by a ductile hinge to said first panel along one edge of said first panel and extending generally orthogonal to said base panel; and a third panel attached by a ductile hinge to said base panel along a second edge of said base panel and being spaced from said first panel whereby a book or papers can be supported upright on said base panel between said second and third panels.

2. A display mount and book support in accordance with claim 1 in which said third panel is angled over said base panel and a fourth panel is attached along one edge of said third panel and is generally parallel to and spaced from said second generally upright panel.

3. A display mount and book support in accordance with claim 2 in which said fourth panel is attached to said third panel with a ductile hinge whereby all of said panels can be folded on ductile hinges for packing in an envelope.

4. A display mount and book support in accordance with claim 3 in which said second generally upright panel has printed indicia thereon.

5. A display mount and book support in accordance with claim 1 in which said first panel has a calendar attached thereto.

6. A display mount and book support in accordance with claim 5 in which said second generally upright panel has printed indicia thereon.

7. A display mount and book support in accordance with claim 6 in which said second and forth generally upright panels and said first and second angled panels are case bound.

8. A display mount and book support in accordance with claim 5 in which said first panel has a transparent banding thereacross and said calendar is attached thereto with a polymer banding.

9. A display mount and book support in accordance with claim 1 in which said base panel is attached to said first panel with a ductile aluminum alloy hinge having an aluminum alloy strip at least 0.0065 inch thick.

10. A display mount and book support in accordance with claim 1 in which said base panel is attached to said first panel with a ductile aluminum alloy hinge having an aluminum alloy strip having magnesium therein.

11. A display mount and book support in accordance with claim 10 in which said base panel is attached to said first panel with a ductile aluminum alloy hinge having an aluminum alloy strip having copper and iron therein.

12. A display mount and book support in accordance with claim 11 in which said base panel is attached to said first panel with a ductile aluminum alloy hinge having an aluminum alloy strip having manganese therein.

* * * * *